United States Patent [19]

Moss

[11] 4,407,039

[45] Oct. 4, 1983

[54] DUST MOP HANDLE ATTACHMENT DEVICE

[75] Inventor: Theron V. Moss, Cleveland, Tenn.

[73] Assignee: SECO Industries, Inc., Cleveland, Tenn.

[21] Appl. No.: 724,956

[22] Filed: Sep. 20, 1976

[51] Int. Cl.[3] ..... B25G 3/24

[52] U.S. Cl. ..... 15/144 A; 15/145; 15/150; 15/229 AP

[58] Field of Search ..... 15/144 A, 147, 148, 15/150, 228, 229, 145; 30/342, 344; 24/129 B, 257 R; 403/9, 274

[56] References Cited

U.S. PATENT DOCUMENTS

| | | | |
|---|---|---|---|
| 466,932 | 1/1892 | Cornell | 24/129 B UX |
| 888,499 | 5/1908 | Herbst | 30/342 X |
| 1,136,603 | 4/1915 | Lamb | 30/342 X |
| 2,470,484 | 5/1949 | Gall | 15/210 B |
| 2,577,651 | 12/1951 | Dewey | 30/344 X |
| 2,655,413 | 10/1953 | Russel | 15/144 A X |
| 2,779,280 | 1/1957 | Strange | 24/129 B X |
| 3,007,730 | 11/1961 | Mills | 15/144 R X |
| 3,029,454 | 4/1962 | Short et al. | 15/147 R |
| 3,440,677 | 4/1969 | Flomerfelt | 15/229 BP X |
| 3,656,207 | 4/1972 | Short | 15/147 B |
| 3,737,935 | 6/1973 | Salzstein | 15/147 A |

FOREIGN PATENT DOCUMENTS

| | | | |
|---|---|---|---|
| 1052025 | 9/1953 | France | 15/147 A |

*Primary Examiner*—Edward L. Roberts

*Attorney, Agent, or Firm*—Maky, Renner, Otto & Boisselle

[57] ABSTRACT

A handle attachment device for easily attaching a handle to a dust mop or the like including a clip that is readily secured to or removed from the frame of the dust mop and a connector member for coupling the clip to the handle. The clip includes only a pair of relatively movable members that capture the shaft of the dust mop frame therein, and such clip may be released for swiveling movement relative to said connector or locked in place as desired.

2 Claims, 5 Drawing Figures

DUST MOP HANDLE ATTACHMENT DEVICE

BACKGROUND OF THE INVENTION

The present invention relates generally as indicated to a handle attachment device for dust mops and the like including particularly an improved clip for attaching a handle to the shaft of a mop frame.

The handle attachment device of the present invention is particularly suited for relatively large or industrial-size dust mops, used to clean the floors of commercial and institutional buildings. The mop and frame arrangement may be of any suitable type as long as there is a mounting shaft or the like that is readily accessible so that a clip or other type of handle attachment device may be secured thereto. One such suitable mop and frame arrangement is disclosed, for example, in U.S. Pat. No. 3,029,454.

In the above-mentioned patent there is shown a clamp for attaching a handle to an accessible shaft on the frame of the dust mop. Such clamp includes two welded clip members that form a bifurcated clip with a pair of bent fingers of the middle clip member over a confronting surface area of the lower clip member. A further upper clip member pivotally secured to the middle clip member is resiliently biased to urge one end toward the lower clip member for holding an accessible shaft therebetween. A mounting bar riveted to the lower and middle clip members and pivotal with respect to the same is used to attach the clamp to a mop handle, and a slide on the mounting bar is movable over a tongue extension of the lower clip member to prevent such pivotal movement.

SUMMARY OF THE INVENTION

In the present invention an improved clip is provided for attaching a handle to an accessible shaft on the frame of a dust mop or the like. The clip is formed of a main plate-like clip member that has an integral forwardly extending leg and additionally a pair of integral forwardly extending offset tab-like portions laterally spaced, respectively, on opposite sides of the leg to form a space within which the accessible shaft may be placed. A closure member mounted for pivotal movement with respect to the clip member has a locking portion that is normally biased toward the clip member leg between the two tab-like portions to close the space and thereby lock the accessible shaft in the clip. The clip is desirably riveted to a rigid connector member for rotational or swivel type movement with respect to the latter. A frictionally restrained slide on the connector member is movable to a lock position thereon into a recess in the main clip member to lock against such rotation, and an opening in the closure member provides access to the rivet for adjustment or removal. A facile fastening arrangement is also desirably provided to secure the connector member to a tubular connector portion of a handle by stamping part of the tubular portion into an opening in the rigid member.

With the foregoing in mind, it is a primary object of this invention to provide a dust mop handle attachment device that is improved in the above-noted respects.

Another object is to facilitate the attachment of a handle to a dust mop or the like.

An additional object is to reduce the number of parts required for a clip mechanism to attach a handle to an accessible shaft on the frame of a dust mop or the like.

A further object is to provide for selective swivel-like movement of a handle relative to the major linear extent of a dust mop or the like.

Still another object is to facilitate securing a clip attaching device to a handle for a dust mop or the like.

Still an additional object is to facilitate the adjustment and/or repair of a clip device for attaching a handle to a dust mop.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
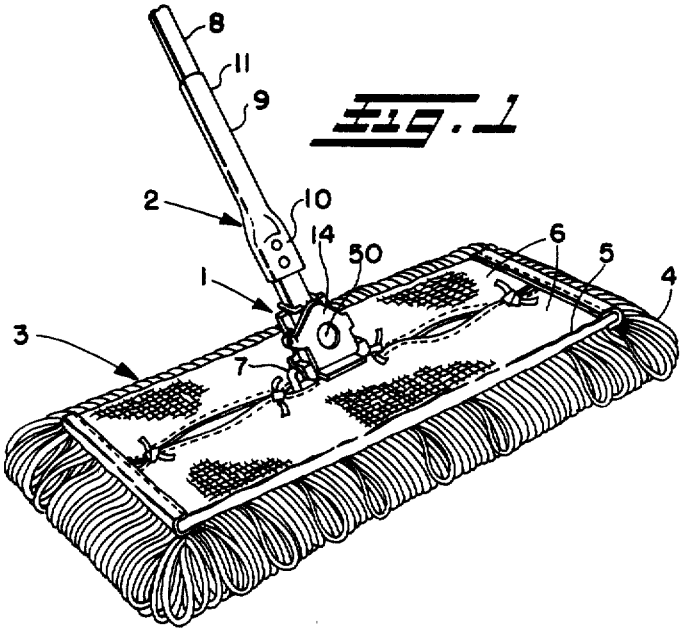
FIG. 1 is a perspective view of a handle attachment device in accordance with the invention shown in operative connection between a dust mop and a handle therefor.

Referring now more particularly to the drawing, wherein like reference numerals designate like parts in the several figures, a handle attachment device in accordance with the invention is generally indicated at 1 and is shown connecting a handle portion 2 to a dust mop 3 in FIG. 1. The dust mop itself may be of any desired type, including for example the type shown, which has fringe 4 sewn to a fabric cover 5. A conventional metal frame is attached to the cover 5 beneath tied overlapping flaps 6. The rigid shaft 7 of the metal frame is accessible through the cover 5 for ease of attachment of the handle attachment device 1 thereto. The handle portion 2 includes a handle 8 and a generally tubular connector coupling 9, which may be deformed at one end 10 to secure the same to the handle attachment device 1 and is open at its other end 11 to receive the handle 8. If desired, the handle and coupling may comprise a single integral part and/or other means may be employed for securing the handle portion 2 to the handle attachment device 1.

Figure 2:
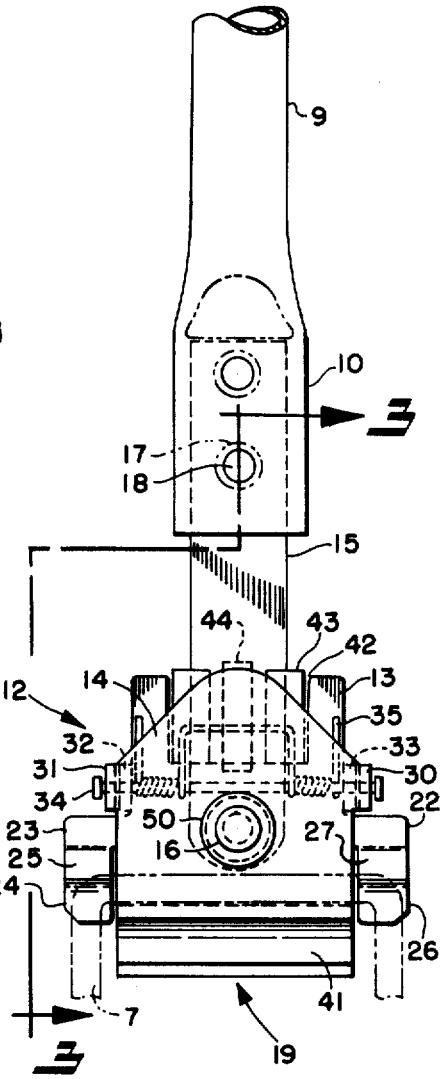
FIG. 2 is a front elevation view of the handle attachment device of FIG. 1.
Figure 3:
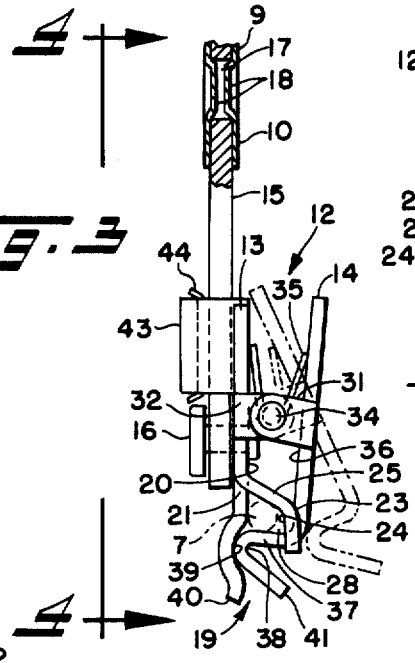
FIG. 3 is a side elevation view, partly in section, of the handle attachment device looking generally in the direction of the arrows 3—3 of FIG. 2.
Figure 4:
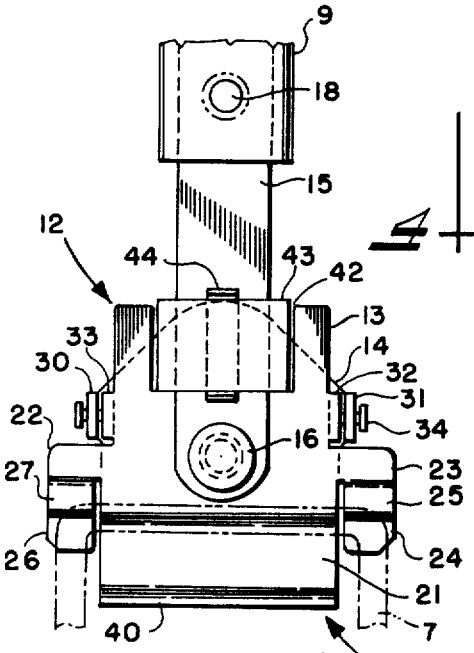
FIG. 4 is a rear elevation view of the handle attachment device looking generally in the direction of the arrows 4—4 of FIG. 3.

Turning now more specifically to FIGS. 2, 3 and 4, the handle attachment device 1 includes a clip 12, which is formed of a main plate-like clip member 13 and a closure member 14 relatively pivotably mounted with respect to the clip member, and a rigid connector member 15 to which the clip 12 is attached by a rivet 16.

One or more holes or recesses 17 near the upper end of the connector member 15 receive the part 18 of the coupling 9 that is stamped, squashed, or otherwise mechanically deformed and urged into such holes thereby to secure the coupling and the connector member in a facile manner without rivets, screws or the like. Preferably, the opposite stamped parts 18 substantially completely fill circular area portions of each hole 17 to assure rigidity of the connection and, if desired, the opposite parts may be stamped to an extent that they nearly or fully abut each other within each hole.

At the forward or lower end 19 of the clip 12, the clip member 13 has a relatively flat base 20, an integral, generally forwardly extending, relatively wide central leg portion 21, an appreciable portion of which is generally coplanar with the base, and a pair of integral tab-like portions 22, 23 laterally positioned respectively on opposite sides of the central leg portion 21. As shown most clearly in FIG. 3, the tab-like portion 23 includes an offset surface part 24, which is generally located in a plane parallel to and spaced from that of the base 20, and the surface 24 is joined to the base by an upstanding angled leg 25. The tab-like portion 22 is similarly formed, as shown at surface part 26 and upstanding angled leg 27 in FIG. 4. Both tab-like portions 22, 23 cooperate with the leg 21 to define the effective boundaries of a space 28 within which the shaft 7 of the mop frame may be captured. The spaced-apart relation of the surface parts 24, 26 and the leg 21 provides an open entrance to the space 28, and the acute angular relation of the angled legs 25, 27 to the portion of the leg 21 that is substantially coplanar with the base 20 aids in locating the shaft 7 close to the apex of that acute angle to bind the shaft thereat.

A pair of ears 30, 31 intermediate the ends of the closure member 14 are aligned with a corresponding pair of ears 32, 33 integral with the clip member 13 and a rigid pivot pin 34 secures the ears together to obtain relative pivotal movement between the members 13, 14. Moreover, a spring 35, which is preferably mounted about the pivot pin 34, resiliently urges the upper or rearward ends of the members 13, 14 away from each other and, thus, the respective forward ends thereof toward each other ordinarily closing the entrance to the space 28.

The closure member 14 includes a flat surface portion 36 and a generally perpendicularly bent leg 37 near the forward end 19 of the clip which forms the locking portion of the clip. The leg 37 is of substantially the same width as the leg 21 and terminates in a curved portion 38 which normally is urged by the spring 35 into a groove 39 near the forward end of the leg 21 of the clip member 13. The groove 39, which as shown extends across the full width of the leg 21, is sufficiently recessed away from the closure member portion 38 so that in closed position, as shown in solid lines in FIG. 3, the leg 37 substantially completely closes the open end or access of the space 28 across substantially the entire width of leg 21 while providing a flat surface facing the shaft 7 to impede inadvertent opening of the clip 12 and release of the shaft.

The forward-most ends of the leg 21 and closure member 14 are also desirably respectively bent or flared outwardly in opposite directions with respect to each other at 40, 41 to form a tapered receiving area for guiding the shaft 7 for attachment by the clip 12 to the handle portion 2. With such an arrangement the clip 12 may be placed in engagement with the shaft 7 located between the flared ends 40, 41, and by applying a downward force on the clip toward the shaft, the latter will urge the forward end of the closure member 14 away from the forward end of the central leg 21 against the force of the spring 35 to provide access to the space 28. The shaft 7 then slips into the space 28 and is captured by the leg 21, the pair of tab-like portions 22, 23 and the leg 37 locking portion of the closure member 14, which snaps closed to secure the shaft in the clip. Alternatively, manual force may be applied to the rearward ends of the clip member 13 and closure member 14 to urge those ends together against the force of the spring 35, as shown in phantom in FIG. 3, to provide access to the space 28 facilitating entry of the shaft 7 therein. After the shaft is so positioned in the clip, the closure member 14 may be released to secure the shaft in place. Likewise, the shaft 7 may be removed from the clip 12 by urging the rearward ends of the clip and closure members toward each other allowing removal of the shaft from the space 28.

Figure 5:
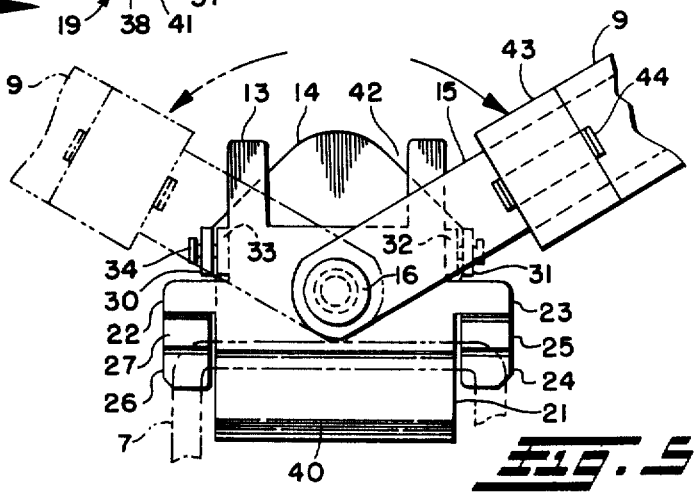
FIG. 5 is a view similar to FIG. 4 showing the swivel action of the handle and connector member relative to the clip portion of the handle attachment device.

The clip member 13 also includes a cutout opening area 42 at the rearward end thereof. Such area 42 is generally aligned with the rigid connector member 15 when the clip 12 is generally linearly aligned with respect to the connector member as shown in FIGS. 1 through 4. When thus oriented, a slide 43 on the connector member 15 is free to be moved to one position extending into at least part of the area 42 to lock the clip 12 in fixed position on the connector member and to another position out of such open area to permit swiveling, pivotal or rotational movement of the clip 12 on the rivet 16 relative to the connector member. A spring or other similar element 44 may be clipped to the slide 43 between the latter and the connector member 15 for frictionally resisting such sliding movement. When the slide 43 is in the locked position of FIGS. 1–4, the clip 12 forms a generally linear extension of the connector member 15. On the other hand, when the slide 43 is in its retracted position outwardly of the area 42 as shown in FIG. 5, the connector member 15 and handle portion 2 attached thereby may be pivoted or swiveled with respect to the clip.

An opening 50 is desirably provided through the closure member 14 to provide direct access to the rivet 16 so that the rivet may be conveniently tightened or replaced as may be required for increasing the useful life of the handle attachment device 1.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. A device for attaching a handle to an accessible shaft of a dust mop frame, comprising:

a plate-like clip member having an integral forwardly extending leg and a pair of integral tab-like portions laterally positioned respectively on opposite sides of said leg with said leg located laterally between said tab-like portions, said tab-like portions being offset relative to said leg to define the effective boundaries of a space that is relatively open at the forward-most end of said space for receiving the shaft, closure means mounted for movement relative to said clip member and cooperable with said leg and tab-like portions thereof for closing said open forward-most end of said space thereby to hold the shaft in said space, and mounting means extending generally rearwardly of said clip member for mounting said clip member to a handle, said mounting means comprising a rigid connector member having at least one opening therein, and further comprising tubular connector means for coupling said connector member at said at least one opening, said means for connecting comprising a portion of said tubular connector means mechanically deformed into said at least one opening, said at least one opening extending through said rigid member, and said portion at least substantially filling a cross-sectional area extent of said opening.

2. A device for attaching a handle to an accessible shaft of a dust mop frame, comprising:

a plate-like clip member having an integral forwardly extending leg and a pair of integral tab-like portions laterally positioned respectively on opposite sides of said leg with sid leg location laterally between said tab-like portions, said tab-like portions being offset relative to said leg to define the effective boundaries of a space that is relatively open at the forward-most end of said space for receiving the shaft, closure means mounted for movement relative to said clip member and cooperable with said leg and tab-like portions thereof for closing said open forward-most end of said space thereby to hold the shaft in said space, and mounting means extending generally rearwardly of said clip member for mounting said clip member to a handle, said mounting means comprising a rigid connector member, and further comprising means for coupling said connector member and said clip member for relative swiveling movement, said clip member and said connector member having aligned generally coplanar portions, said clip member further including an opening in the rearward end thereof, and further comprising slide means slidable on said connector member to a lock position within at least part of said opening for precluding such relative swiveling movement and to an unlock position out of said opening to permit such relative swiveling movement, and resilient spring means operatively coupled to said slide means for movement therewith and positioned between said connector means and said slide means for frictionally resisting sliding movement of said slide means.

* * * * *